United States Patent [19]

Brundage

[11] 4,102,234

[45] Jul. 25, 1978

[54] PICK HARNESS

[76] Inventor: Walter G. Brundage, 27 Haberem Ave., Unionville, Conn. 06085

[21] Appl. No.: 783,076

[22] Filed: Mar. 30, 1977

[51] Int. Cl.[2] ..... G10D 3/16

[52] U.S. Cl. ..... 84/322

[58] Field of Search ..... 84/322

[56] References Cited

U.S. PATENT DOCUMENTS

| | | | |
|---|---|---|---|
| 408,052 | 7/1889 | Stoll | 84/322 |
| 1,184,561 | 5/1916 | Napoletano | 84/322 |
| 3,648,558 | 3/1972 | Chenette | 84/322 |
| 3,992,975 | 11/1976 | Gallagher | 84/322 |

*Primary Examiner*—L. T. Hix
*Assistant Examiner*—Benjamin R. Fuller
*Attorney, Agent, or Firm*—Prutzman, Hayes, Kalb & Chilton

[57] ABSTRACT

A harness is provided for securely holding a conventional plectrum or pick in firm engagement with a guitar player's thumb, the harness consisting of a simple flexible and resilient strap contoured to fit around the thumb in advance of the first knuckle and being provided with a central portion which is slit to receive and hold the pick firmly against the undersurface of the thumb with the pointed end of the pick protruding through one of the slits into playing position.

5 Claims, 4 Drawing Figures

PICK HARNESS

This invention relates generally to guitar playing equipment and, more particularly, to a novel pick harness for attaching a conventional pick to a player's thumb to aid in playing of the guitar.

BACKGROUND AND SUMMARY OF THE INVENTION

Most guitar players prefer to use a conventional pick or plectrum which is a small thin piece of plastic or other material having a generally triangular configuration. In use, the pick is pressed between the thumb and adjacent index finger with the pointed end of the pick extending downwardly in position to pluck or pick the strings. The need to maintain constant pressure between the finger and thumb can be exceedingly fatiguing particularly over long periods of time and even though extreme care is exercised, the pick frequently is displaced or dislodged and dropped.

To overcome these deficiencies, it has been proposed heretofore to modify the design or shape of the pick so that it is provided with a ring-like or other portion that can be attached to the thumb or else to provide a structure with thumb attaching means to which a modified or conventional pick can be attached. An example of the latter is described in U.S. Pat. No. 3,648,558 to Chenette. As described, the pick is made integral with, or can be attached to, a sheet-like element of semirigid material having extensions which fit around the end of the thumb and over the thumbnail and which is retained in place by an elastic band passing around the base of the thumb.

The disadvantages of these prior expedients are that the pick does not function as satisfactorily nor have as good tonal qualities as is the case when a conventional pick is simply held between the thumb and index finger, and the resulting change in playing characteristics and feel of the pick will frequently have an adverse effect upon the performance of the player. Further such devices are usually awkward if not uncomfortable to use and introduce complicated additional structure interfering with playing and frequently causing unwanted sounds.

Accordingly, it is an object of my invention to provide an arrangement for holding a conventional pick securely in firm contact with the thumb which simulates the effect or results obtained when a conventional pick is held between the thumb and index finger.

Another object is to provide such an arrangement which will hold a conventional commercially available pick more securely despite variations in thickness of the pick and which will hold the pick more securely against the thumb with adjustability for variations in thumb size.

A further object is to provide a simplified construction which is economical to fabricate and which will have a minimum interference with the playing performance of the user.

These and other advantages and objects which will be apparent from the following description are achieved in accordance with the present invention by providing a harness consisting of a simple flexible strap contoured to fit around the thumb in advance of the first knuckle and which has a central portion dimensioned to provide an area at least comparable in size to a conventional pick and which is slit to receive and hold such a pick firmly against the undersurface of the thumb with the pointed end of the pick protruding through one of the slits into playing position.

DESCRIPTION OF PREFERRED EMBODIMENT

Figure 2:
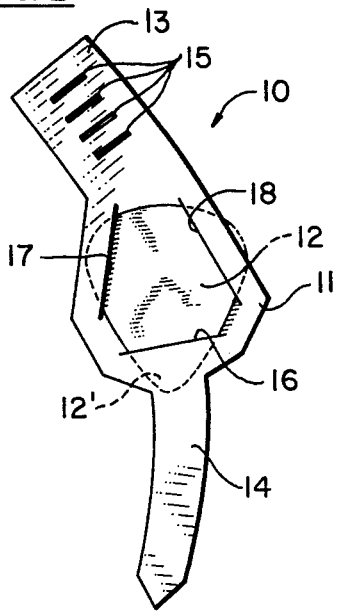
FIG. 2 is a plan view of the harness.
Figure 3:
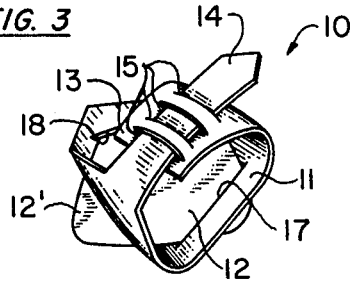
FIG. 3 is an isometric view of the pick harness removed from the player's thumb.
Figure 4:
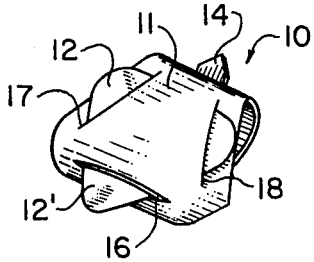
FIG. 4 is an isometric view similar to FIG. 3 but taken from the opposite side.

Referring to the drawing in detail, the preferred embodiment of a pick harness made in accordance with the invention comprises a single strap 10 as best shown in FIG. 2 of thin flexible and preferably resilient material. While leather and various similar materials may be used, I have found that rubber-like materials (including rubber) are preferable as the stretchability and resilience of such material aids in placing the harness in tight engagement on the player's thumb and also facilitates the insertion, removal and replacement of the pick. As a specific example, a strap formed of 3/64 inch thick injection-molded rubber has been found to be very advantageous.

Figure 1:
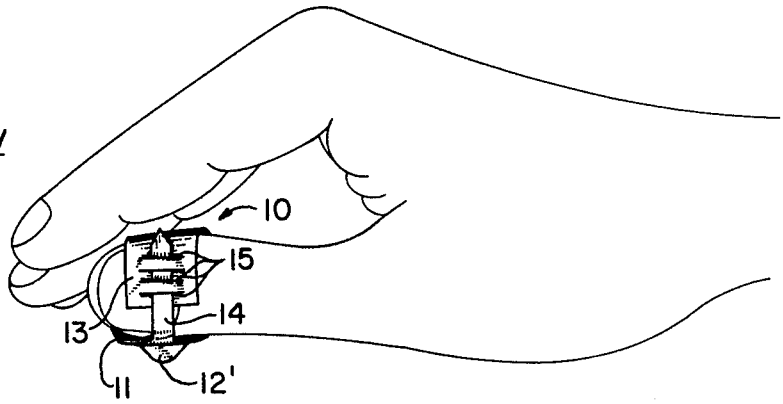
FIG. 1 is an isometric view of the pick harness of my invention with a conventional pick in place and secured upon the thumb of a player.

Also as best shown in FIG. 2, the strap 10 has a central portion 11 which is of slightly larger area than a conventional pick 12 shown in phantom. A convenient size is an area of approximately 1 1/4 inches in length and width. The specific contour of central portion 11 is not critical but the one shown in the drawing is preferred from an appearance and functional standpoint. The central portion 11 is adapted to firmly engage against the underside of the thumb forwardly of the first knuckle as best shown in FIG. 1. The strap 10 is firmly held in position on the thumb by the strap ends 13 and 14 which are adapted to be secured together at the upperside of the thumb as shown in the drawing. The means for securing the ends 13 and 14 together is optional but I prefer the simple effective arrangement shown in the drawing wherein the strap end 13 is made wider than the strap end 14 and is provided with slits 15 through which the more narrow end 14 can be threaded and pulled to the desired tautness. The strap ends 13 and 14 are angularly related and preferably provided with a slight inward curvature as shown in FIG. 2 so as to compensate for the normal tapered shape of the player's thumb and so that when the harness is assembled on the thumb, it will be seated snugly in front of the first knuckle as shown. The securing of the ends 13 and 14 together is, of course, adjustable to accomodate for variations in thumb size of different players.

To secure the pick 2 in the harness, the central portion 11 is provided with a transverse slit 16 and two angularly related slits 17 and 18. These slits are adapted to receive the apices of the conventional pick 12 with the more pointed or plucking apex 12' of the pick engaged in the transverse slit 16. Because of the stretchability and resilient properties of the material from which the strap is formed, it is a simple matter to insert or remove the pick but at the same time when the harness is drawn tautly about the thumb, the pick is securely locked in position. This holding arrangement also is effective although there may be minor variations in the thickness or other dimensions of the commercially available picks which are intended to be used with the harness of the present invention. It will be noted that the center portion of the pick 12 is disposed on the underside of the strap portion 11 so that it is pressed into direct contact with the thumb and the holding pressure is exerted by the strap from the opposite side so that the effect closely simulates the conditions or feel obtained when a pick is held between the thumb and index finger in the usual manner and to which the player is normally accustomed.

As the pick 12 is formed of semirigid material, it will, when secured to the thumb by the harness, extend tangentially to the inner surface of the thumb and, as the strap end 14 is generally perpendicular to the slit 16 and is pulled tightly around and follows the contour of the thumb, this exposes the pick apex or point 12' and enables it to extend downwardly for picking the strings of the guitar in substantially the same way as though the pick were held between the thumb and index finger in the conventional manner. This result together with the thinness and flexibility of the harness assures that it will not change the tonal qualities produced by the pick or have any adverse effects upon the player's skill and that no alteration in playing technique is required.

As will be apparent, the harness is simple and economical to fabricate and is not likely to require repair or replacement over long periods of use. Yet, despite its simplicity, it will hold the pick more securely and grip the thumb more securely than has been possible heretofore. Furthermore, since the harness is of small size and there are no rigid or semirigid parts (other than the pick itself), the harness is comfortable to use and will not interfere with the playing or cause unwanted sounds.

While the invention has been described in connection with a specific preferred embodiment, it will be apparent that modifications and variations may be provided by persons skilled in the art without departing from the teachings of the present invention.

I claim:

1. In combination with a conventional guitar pick having flat sides and a generally triangular configuration, a harness for securing the pick in normal playing position on the thumb of a player, said harness comprising a thin strap of flexible resilient material having a flat central portion overlying a flat side of the pick and provided with triangularly related slits receiving and securing the apices of the pick and having strap ends extending from opposite edges of the central portion with one of the strap ends extending generally perpendicularly to one of the slits, and means for adjustably securing the strap ends together about the thumb of a player with the flat central portion of the strap holding a flat side of the pick against the underside of a player's thumb with an apex of the pick projecting through said one of the slits tangentially to the underside of the player's thumb.

2. A harness as defined in claim 1 wherein the harness is formed of rubber or rubber-like material.

3. A harness as defined in claim 1 wherein the strap ends are angularly related.

4. A harness as defined in claim 3 wherein the strap ends are formed with a slight inward curvature.

5. A harness as defined in claim 1 wherein the strap ends are of different width and the strap end of greater width is provided with transverse slits through which the other end is adapted to be threaded.

* * * * *